US006247431B1

(12) United States Patent
Toriumi

(10) Patent No.: US 6,247,431 B1
(45) Date of Patent: Jun. 19, 2001

(54) ELECTROMAGNETIC VALVE ACTUATING APPARATUS FOR INTERNAL COMBUSTION ENGINE

(75) Inventor: Masaki Toriumi, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/489,887

(22) Filed: Jan. 24, 2000

(30) Foreign Application Priority Data

Jan. 27, 1999 (JP) ..... 11-018752

(51) Int. Cl.[7] ..... F01L 9/04; F16K 31/06

(52) U.S. Cl. ..... 123/90.11; 251/129.01; 251/129.1; 251/129.16

(58) Field of Search ..... 123/90.11; 251/129.01, 251/129.02, 129.1, 129.15, 129.16

(56) References Cited

U.S. PATENT DOCUMENTS

| | | | | |
|---|---|---|---|---|
| 4,087,038 | * | 5/1978 | Yagi | 228/114.5 |
| 5,095,856 | * | 3/1992 | Kawamura | 123/90.11 |
| 5,690,064 | * | 11/1997 | Izuo | 123/90.11 |
| 5,704,314 | * | 1/1998 | Allmendinger et al. | 123/90.11 |
| 6,031,303 | * | 2/2000 | DeGrace | 310/42 |
| 6,079,609 | * | 6/2000 | Fochtman | 228/113 |

FOREIGN PATENT DOCUMENTS

| | | |
|---|---|---|
| 197 28 348 | 1/1999 | (EP) . |
| 0 922 520 | 6/1999 | (EP) . |
| 0 922 526 | 6/1999 | (EP) . |
| 9-60512 | 3/1997 | (JP) . |

OTHER PUBLICATIONS

Konno Tsuneo, "Valve System For Internal Combustion Engine.", Patent Abstracts of Japan, #09060514, Apr. 3, 1997.

* cited by examiner

*Primary Examiner*—Weilun Lo
(74) *Attorney, Agent, or Firm*—Foley & Lardner

(57) ABSTRACT

An electromagnetic valve actuating apparatus includes an armature moved by a solenoid, and an armature shaft joined with the armature, for transmitting motion from the armature to a valve. The armature is formed with a tapered joint hole, and the armature shaft has a tapered end portion which is fit in the tapered joint hole so that the mating joint surfaces are in the form of a conical surface. The armature is made of a ferromagnetic material whereas the armature shaft is made of a material which is non-magnetic and lower in specific gravity than the material of the armature.

9 Claims, 2 Drawing Sheets

ELECTROMAGNETIC VALVE ACTUATING APPARATUS FOR INTERNAL COMBUSTION ENGINE

BACKGROUND OF THE INVENTION

The present invention relates to an electromagnetic valve actuating apparatus for opening and closing a valve such as an intake valve or an exhaust valve of an internal combustion engine.

A Japanese Patent Kokai Publication No. H09(1997)-60512 discloses an electromagnetic valve actuating system including an armature and an armature shaft (or valve stem) which are fastened together through a two-split cotter.

SUMMARY OF THE INVENTION

It is an object of the present invention to provide an electromagnetic valve actuating apparatus having a reliable joint structure.

According to the present invention, a valve actuating apparatus for an internal combustion engine, comprises an armature and an armature shaft joined with the armature, for transmitting movement of the armature to a valve. The armature has a tapered joint hole, and the armature shaft has a tapered joint portion joined with the armature by fitting in the joint hole of the armature.

According to another aspect of the invention, the armature has a center portion, and the armature shaft has a joint portion which is joined with the center portion of the armature by friction welding. The joint portion of the armature shaft may be fit in a joint hole formed in the center portion of the armature.

DETAILED DESCRIPTION OF THE INVENTION

Figure 1:
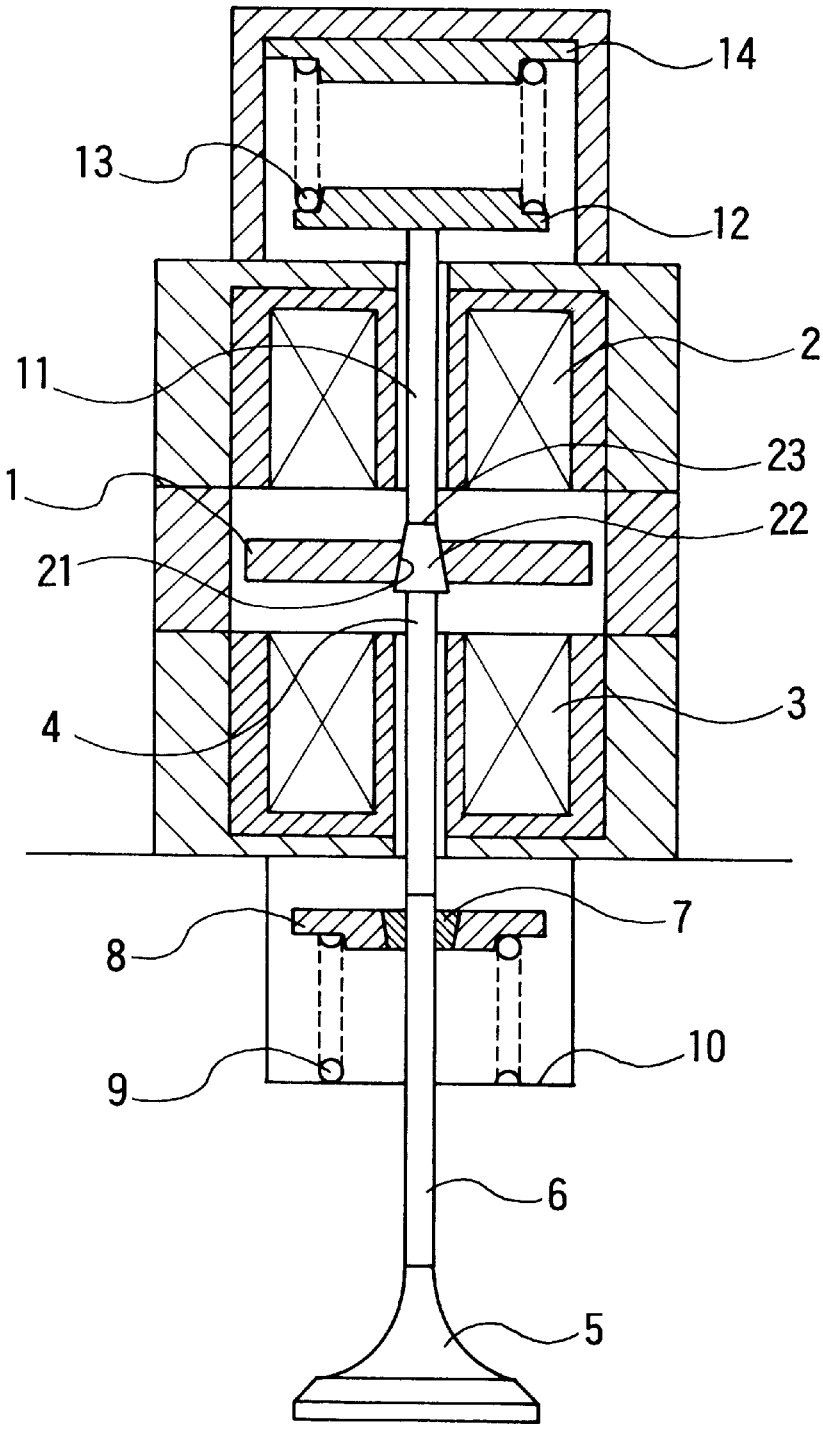
FIG. 1 is a view showing a valve actuating apparatus according to one embodiment of the present invention.

FIG. 1 shows an electromagnetic valve actuating apparatus according to one embodiment of the present invention.

The valve actuating apparatus includes an armature 1, and upper and lower solenoids 2 and 3 disposed on both sides of the armature 1. In this example, the upper solenoid 2 is a valve closing solenoid disposed on the upper side of the armature 1, and the lower solenoid 3 is a valve opening solenoid on the lower side.

An armature shaft 4 extends downwards from the center of the armature 1. The armature 1 and the armature shaft 4 is formed as a single integral unit. The armature shaft 4 passes through a center hole of the lower solenoid 3 in such a manner that the armature shaft 4 can reciprocate in the center hole of the lower solenoid 3. The lower end of the armature shaft 4 abuts on an upper end of a valve stem 6 of a valve 5 which, in this example, is an intake valve or an exhaust valve of an internal combustion engine.

A return spring 9 for urging the valve 5 in the valve closing direction is disposed between a spring seat 8 fixedly mounted on the valve stem 6, and a seat surface 10 formed in a cylinder head of the engine. In this example, the spring seat 8 is fixed to the valve stem 6 through a cotter 7.

A spring shaft 11 extends upwards, from the center of the armature 1, in alignment with the armature shaft 4. The upper solenoid 2 has a center hole receiving the spring shaft 11 in a manner to allow reciprocation of the spring shaft 11 therein. The lower end of the spring shaft 11 abuts on the upper end of the armature shaft 4.

A return spring 13 for urging the valve 5 in the valve opening direction is disposed between a spring seat 12 fixed to the upper end of the spring shaft 11, and another spring seat 14. In this example, the spring seat 12 is fixed to the upper end of the spring shaft 11 by press fitting, and the spring seat 14 is fixed to a casing of the apparatus.

The return springs 9 and 13 act, as a pair, to hold the armature 1 and the valve 5 normally at a neutral position.

The valve 5 is opened by deenergizing the valve closing upper solenoid 2 and then energizing the valve opening lower solenoid 3 to pull the armature 1 downwards. The armature 1 moves downwards against the force of the return spring 9 and thereby forces the valve 5 to lift downwards to an open position. The valve 5 is closed by deenergizing the valve opening lower solenoid 3 and then energizing the valve closing upper solenoid 2 to pull the armature 1 upwards. Accordingly, the valve 5 moves upwards by the force of the return spring 9, to a closed position at which the valve 5 rests on a valve seat (not shown).

In this example, the armature 1 and the armature shaft 4 are joined by friction welding utilizing frictional heat at high temperatures to fuse them.

Figure 2:
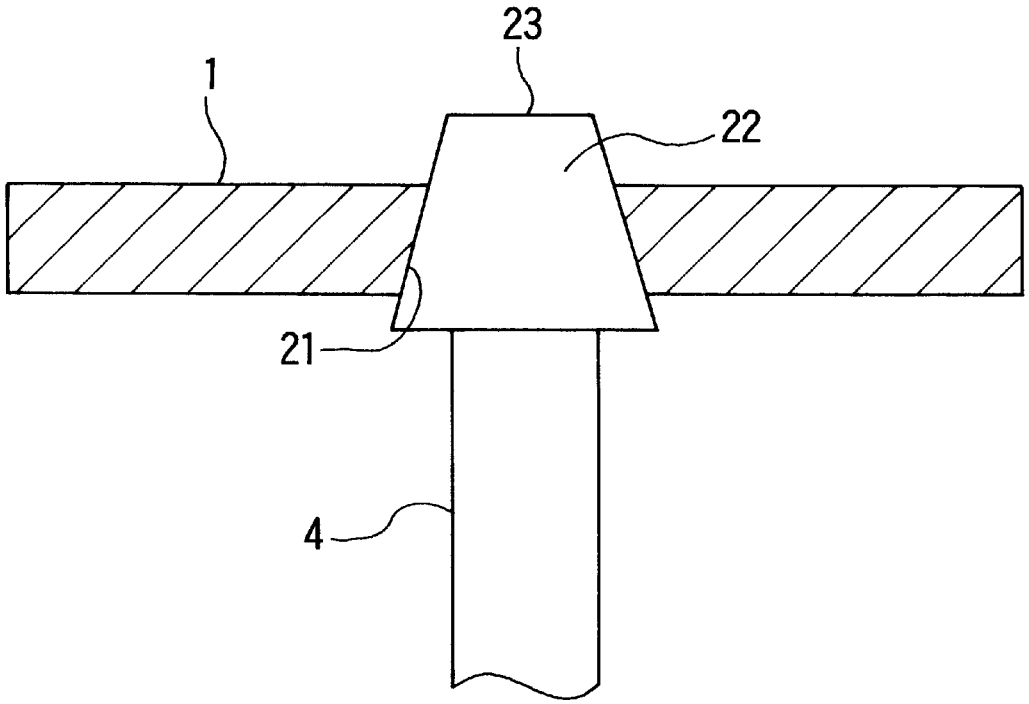
FIG. 2 is an enlarged sectional view showing a joint structure between an armature and an armature shaft shown in FIG. 1.

The armature 1 has a center joint portion, and the armature shaft 4 has a joint portion joined with the center joint portion of the armature 1. In the example shown in FIG. 2, the center joint portion of the armature 1 defines a joint hole 21 formed at the center of the armature 1, and the joint portion of the armature shaft 4 is an upper end portion (or head) 22 fit in the joint hole 21 of the armature 1. In the example of FIG. 2, the mating surfaces are tapered toward the upper end. The upper end portion 22 of the armature shaft 4 is enlarged like a poppet, so that the upper end portion 22 is larger in sectional size than the remaining shank of the armature shaft 4. The upper end portion 22 of the armature shaft 4 has an outside conical surface so that the diameter is decreased gradually to the upper end 23 of the armature shaft 4. In conformity with the tapering shape of the upper end portion 22 of the armature shaft 4, the joint hole 21 of the armature 1 is tapered to have an inside conical surface so that the diameter of the joint hole 21 is decreased gradually to the upper end. The mating outside and inside conical surfaces are joined together by friction welding.

In the example of FIG. 2, the upper end portion 22 of the armature shaft 4 projects, beyond the armature 1, in the direction away from the valve 5, toward the upper solenoid 2. The upper end 23 of the armature shaft 4 serves as an abutting surface on which the lower end of the spring shaft 11 abuts by receiving the force of the return spring 13. In this example, the upper end 23 has a flat surface to which the axis of the shaft 4 is perpendicular.

In this example, the upper end portion 22 of the armature shaft 4 is in the form of a frustum of a right circular cone whose height is greater than the thickness of the armature 1.

Moreover, the armature 1 is made of ferromagnetic material whereas the armature shaft 4 of this example is made of material which is non-magnetic and lower in specific gravity than the material of the armature 1. In this example, the armature 1 is made of Fe, and the armature shaft 4 is made of Ti or TiAl.

The spring shaft 11 is made of the same material (Ti or TiAl) as the armature shaft 4 for weight reduction.

This joint structure between the armature 1 and the armature shaft 4 is secure, free of unwanted disjoining and breakage due to loosening, more reliable and more durable. This joint structure makes it easier to form right angles by a working operation after the joining operation between the armature 1 and the armature shaft 4, and prevents the perpendicularity from being degraded by loosening.

The tapered joint structure increases the area of the joint interface between the armature 1 and the armature shaft 4, and thereby increases the strength of the joint. This joint structure does not require an increase in the diameter of the armature shaft 4. The slender armature shaft 4 is advantageous in preventing an increase in valve opening and closing stroke time (deterioration in response time) and preventing an increase in electric power consumption.

The upward tapering design of the joint surfaces helps prevent the armature 1 from falling even if the joint structure is disjointed.

The upper end of the armature shaft 4 projecting upwards from the armature 1 and abutting on the lower end of the spring shaft 11 is helpful to improve. the wear and abrasion resistance. As the material of the armature shaft 4 which need not be magnetic, it is possible to employ a material having a high wear and abrasion resistance, or a material accepting surface hardening, and thereby to form the wear resistant surface 23 for abutting against the spring shaft 11.

The armature shaft 4 of the material having the lower specific gravity is helpful in reducing the weight of the movable part, improving the response characteristic, and reducing the power consumption.

Figure 3:
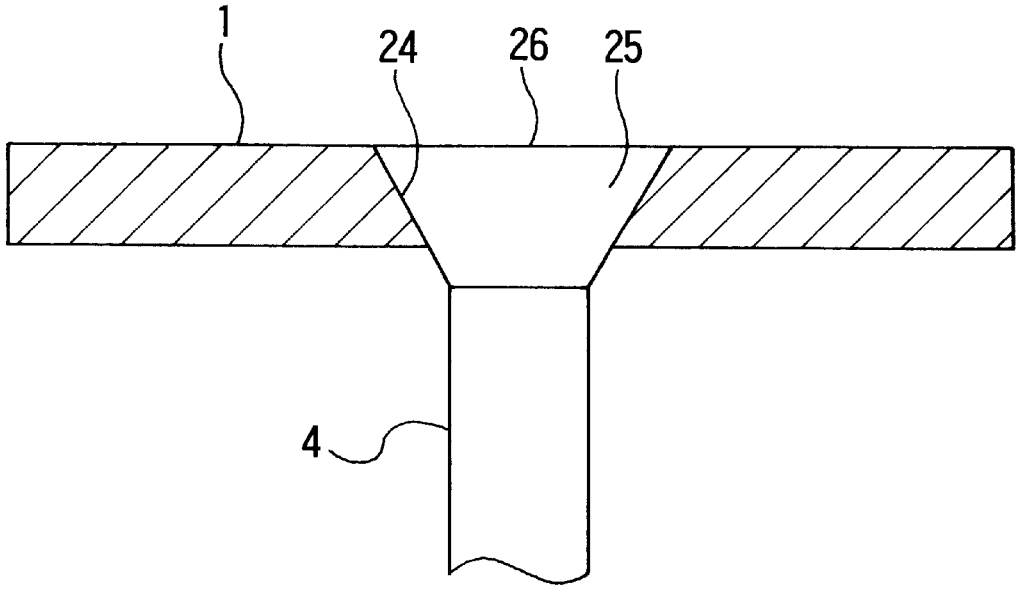
FIG. 3 is an enlarged sectional view showing a joint structure according to another embodiment of the present invention.

FIG. 3 shows a joint structure between the armature 1 and the armature shaft 4 according to a second embodiment of the present invention. In this embodiment, the armature 1 has a downward tapering center joint hole 24, and the armature shaft 4 has a downward tapering upper end portion 25 fit in the center joint hole 24 of the armature 1 and joined with the armature 1 by friction welding. The upper end portion 25 of the armature shaft 4 has an outside conical surface having a circular cross section whose diameter is increased gradually toward the upper end 26 of the armature shaft 4. The joint hole 24 of the armature 1 has an inside conical surface having a circular cross section whose diameter is increased gradually to the upper end.

The upper end 26 of the armature shaft 4 is bared through the joint hole 24 in the upper surface of the armature 1, and used as an abutting surface abutting against the lower end of the spring shaft 11. In the example shown in FIG. 3, the upper end 26 of the armature shaft 4 is flat and flush with the flat upper surface of the armature 1.

This joint structure can provide the same effects as in the first embodiment, except that the armature 1 is not prevented from falling in case of disjunction of the armature 1 from the armature shaft 4. Besides, it is easy to increase the area of the upper end 26 serving as the abutting surface.

In the present invention, the armature shaft may be a valve stem of an engine valve.

In the illustrated embodiments, the armature 1 and the armature shaft 4 are joined together by fitting the upper end of the armature shaft in the joint hole formed in the armature. However, it is optional to join the armature 1 and the armature shaft 4 by friction welding between end surfaces of the armature shaft and the armature.

This application is based on a prior Japanese Patent Application No. H11-18752. The entire contents of this Japanese Patent Application No. H11(1999)-18752 with a filing date of Jan. 27, 1999 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A valve actuating apparatus for an internal combustion engine, the valve actuating apparatus comprising:

an armature formed with a tapered joint hole;

first and second solenoids for moving the armature between the first and second solenoids;

first and second return springs for normally holding the armature at a neutral position; and an armature shaft which has a first end that is engageable with a top of a valve stem of a valve actuated by the valve actuating apparatus, said armature shaft having a tapered portion at a second end which is fittingly received in the tapered joint hole and which tapers away from the first end of the armature shaft.

2. The valve actuating apparatus according to claim 1 wherein the armature shaft extends through the second solenoid, the armature has a first surface facing to the first solenoid and a second surface facing to the second solenoid, the joint hole is tapered toward the first solenoid, and the tapered end portion of the armature shaft is tapered toward the first solenoid.

3. The valve actuating apparatus according to claim 1 wherein the armature shaft is joined to the armature by friction welding between the tapered end portion of the armature shaft and the joint hole of the armature which is tapered so as to fit over the tapered end portion of the armature shaft.

4. The valve actuating apparatus according to claim 1 wherein the valve actuating apparatus further comprises a spring shaft extending through the first solenoid, the joint hole of the armature has a first open end opening in a first surface of the armature facing toward the first solenoid and a second open end opening in a second surface of the armature facing toward the second solenoid, the armature shaft has an end surface bared in the first open end of the joint hole and arranged to receive an end of the spring shaft.

5. The valve actuating apparatus according to claim 1 wherein the armature is made of a ferromagnetic material, and the armature shaft is made of a material which is non-magnetic and lower in specific gravity than the material of the armature.

6. A valve actuating apparatus for a valve of an internal combustion engine which has a valve head and valve stem, the valve actuating apparatus comprising:

an armature formed with a tapered joint hole;

a solenoid for moving the armature;

an armature shaft which has a first lower end that is engageable with a top of the valve stem of the valve actuated by the valve actuating apparatus, said armature shaft having a tapered joint portion formed at a second upper end which is fittingly received in the tapered joint hole and which tapers away from the first end of the armature shaft.

7. The valve actuating apparatus according to claim 6 wherein the joint hole of the armature has an inside conical surface, and the tapered joint portion of the armature shaft has an outside conical surface fit in the inside conical surface of the joint hole.

8. The valve actuating apparatus according to claim 6 wherein the armature shaft extends from the armature in a first axial direction toward the valve, and the armature shaft extends, through the joint hole of the armature, in a second axial direction opposite to the first axial direction, up to an end surface facing in the second axial direction.

9. The valve actuating apparatus according to claim 6 wherein the armature shaft extends from the armature in a first axial direction toward the valve, and the tapered joint portion of the armature shaft is tapered along a second axial direction opposite to the first axial direction.

* * * * *